United States Patent [19]

Barrows

[11] Patent Number: 4,836,306

[45] Date of Patent: Jun. 6, 1989

[54] DOWN HOLE DRILL CHUCK LOCK

[75] Inventor: Robert E. Barrows, Fincastle, Va.

[73] Assignee: Ingersoll-Rand Company, Woodcliff Lake, N.J.

[21] Appl. No.: 132,814

[22] Filed: Dec. 14, 1987

[51] Int. Cl.[4] ..... E21B 10/62

[52] U.S. Cl. ..... 175/321; 175/415; 279/1 DA; 279/99; 285/92

[58] Field of Search ..... 175/321, 367, 368, 369, 175/370, 415, 416, 417, 418; 384/95, 96; 279/1 DA, 99, 100; 285/81, 91, 92

[56] References Cited

U.S. PATENT DOCUMENTS

| | | | |
|---|---|---|---|
| 1,669,186 | 5/1928 | Bunker | 285/81 |
| 1,922,559 | 8/1933 | Strobel | 175/417 |
| 2,680,358 | 6/1954 | Zublin | 285/91 |
| 3,163,244 | 12/1964 | Zimmerman | 175/418 |
| 3,385,613 | 5/1968 | McCall | 285/92 |
| 4,067,404 | 1/1978 | Crase | 285/91 |
| 4,083,415 | 4/1978 | Kita et al. | 175/417 |
| 4,096,917 | 6/1978 | Harris | 175/418 |
| 4,426,105 | 1/1984 | Plaquin et al. | 285/92 |
| 4,706,764 | 11/1987 | Hughes | 175/415 |

*Primary Examiner*—Jerome W. Massie
*Assistant Examiner*—Terry L. Melius
*Attorney, Agent, or Firm*—Walter C. Vliet

[57] ABSTRACT

Disclosed is a means for retaining drill chucks for down hole drills including a circumferential groove cut in both the drill chuck and the wear sleeve, into which it is inserted, in complimentary mating orientation whereby the circumferential groove forms a channel which is filled with ball bearings, for example through access ports provided in the wear sleeve. The ball bearings prevent uncoupling and may be removed readily thereafter permitting removal of the chuck.

6 Claims, 1 Drawing Sheet

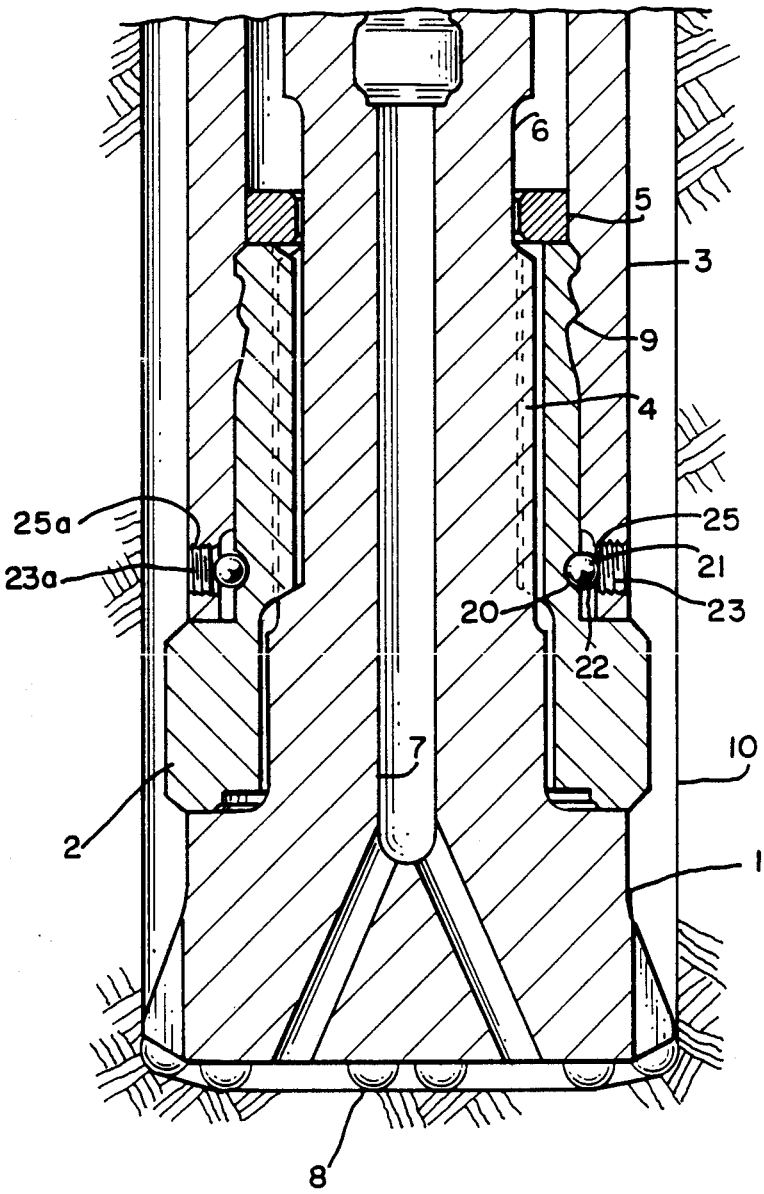
6
5
3
9
4
25a
23a
25
21
23
20
22
7
10
2
1
8

DOWN HOLE DRILL CHUCK LOCK

BACKGROUND OF THE INVENTION

There have been reported cases in drilling deep holes, such as for oil and gas, where the bit chuck has unscrewed from the down hole drill during operation, thus leaving the chuck end drill bit in the hole, often causing expensive problems.

The unscrewing of the chuck is believed to be caused by the extreme amount of torsional windup experienced in a 3000, 5000 foot drill string during the drilling operation and the drill string rapidly unwinding when the down hole drill is lifted from the bottom of the hole. The resulting rotation backwards of some 3 or more turns unscrews the chuck particularly in the case where the drill bit is partially stuck or perhaps once unloosened by continued reverse rotation. The loss of drill bit chucks may also be occasioned by the improper intentional reverse rotation of the drill string during stuck operation.

OBJECT OF THE INVENTION

The object of the invention is to provide a simple safe reliable means of securing the drill chuck to the down hole drill wear sleeve whereby it cannot be unintentionally removed from the wear sleeve. This and other objects of the invention are obtained in a chuck locking device comprising:

A chuck member in threaded engagement with a mating member, the chuck member being provided with a circumferential groove in the mating thread and the mating member having a complimentary and aligned mating circumferential groove in the mating threads, the complimentary mating grooves forming a channel having inserted therein a plurality of locking means whereby the locking means prevent uncoupling of the threaded engagement.

BRIEF DESCRIPTION OF THE DRAWING

FIG. 1 shows a cross section of the cylindrical drill bit, drill bit chuck, and drill casing according to the present invention.

DESCRIPTION OF THE PREFERRED EMBODIMENT

I will now describe my invention in terms of a Preferred Embodiment.

Referring to FIG. 1. A drill bit 1 is shown disposed within a drill chuck 2 which in turn is disposed and threadingly engaged by thread 9 in a cylindrical container or wear sleeve 3. The bit 1 is engaged in the collar by a spline 4 which allows the bit to reciprocate axially but not rotate within the chuck.

The bit is prevented from exiting the chuck as it reciprocates by a retainer 5 which cooperates with a circumferential groove 6 in the bit. The chuck coller 2 secures the retainer 5 within the casing or wear sleeve 3. The bit is provided with a central bore 7 which distributes air or other drilling fluid to the face of the drill. The drill is shown inserted in a bore hole 10. Impact, imparted to the drill bit 1 by a reciprocating hammer (not shown) is transmitted to the rock of the bore hole by means of button compacts 8 which fracture the rock and the rock chips are carried off by the drilling fluid supplied to the central bore 7 about the periphery of the drill. The entire drill is rotated by a means (not shown) such as a conventional rotary drill motor on a drill rig.

In the past in operation it has been found that the drill chuck 2 will unwind or unthread itself in the casing or wear sleeve 3 with the resultant loss of the drill bit 1 and drill chuck 2. In order to prevent this from occurring the present invention shows two complimentary circumferential grooves with one groove 20 on the drill chuck 2 and one groove 21 in adjacent complimentary position on the casing 3. The complimentary grooves form a circular channel into which locking devices, for example, as shown in the Preferred Embodiment, ball bearings 22 are disposed after the drill collar is threadingly engaged in the casing 3.

The balls 22 are inserted in the channels formed by grooves 20, 21 through access ports 25 and/or 25A and are retained therein by means of a convenient plug 23, 23A. In the Preferred Embodiment the entire circumferential channel formed by grooves 20, 21 are filled with balls 22. This provides an excellent bearing surface for preventing the drill chuck 2 from unscrewing from thread 9. In the Preferred embodiment two access ports 25, 25A are provided in order to ease both the insertion of the balls 22 and their removal at a later time when removal of the drill chuck is desirable. The dual ports also provide for ease of flushing the channel and for grease filling of the channel with the balls in place should that be desirable.

As can be appreciated by one skilled in the art the retaining device suggested by the present invention will securely hold the drill chuck 2 in the casing 3 and prevent the unscrewing of the thread 9 during down hole operation. The securing means will not readily deform and provides for reliable service in demanding down hole drill operation.

Having described my invention in terms of a preferred Embodiment I do not wish to be limited in the scope of my invention except as claimed.

I claim:

1. A chuck locking device comprising: a chuck member in threaded engagement with a mating member, each of said members containing a mating thread in cooperating surfaces; said chuck member being provided with a circumferential groove in the cooperating surfaces containing the mating thread; and said mating member having a complimentary and aligned mating circumferential groove opposite said circumferential groove in said chuck member forming a circumferential chamber; and said chamber having inserted therein a plurality of individual and selectively removable freely dispersed locking means whereby said locking means when inserted and freely dispersed in said chamber prevent uncoupling of said threaded engagement.

2. A chuck locking device according to claim 1 wherein: said circumferential grove in said chuck member is of semicircular cross section.

3. A chuck locking device according to claim 2 wherein: said mating member circumferential groove is of semicircular cross section.

4. A chuck locking device according to claim 1 wherein: said locking means are spherical balls.

5. A chuck locking device according to claim 1 wherein: said locking means substantially fill said circumferential chamber formed by said complimentary mating grooves.

6. A chuck locking device according to claim 5 wherein: said locking means are balls and said complimentary mating grooves form a circular cross section chamber about the circumference of the cooperating surfaces containing said mating threads.

* * * * *